United States Patent [19]

Sasaki et al.

[11] Patent Number: 4,726,347

[45] Date of Patent: Feb. 23, 1988

[54] ELECTRONIC IGNITION SIGNAL DISTRIBUTOR FOR AUTOMOBILE ENGINE

[75] Inventors: Shoji Sasaki; Kenji Tabuchi, both of Katsuta, Japan

[73] Assignee: Hitachi, Ltd., Tokyo, Japan

[21] Appl. No.: 46,159

[22] Filed: May 5, 1987

[30] Foreign Application Priority Data

May 8, 1986 [JP] Japan ..... 61-105548

[51] Int. Cl.[4] ..... F02P 7/077

[52] U.S. Cl. ..... 123/643; 123/416

[58] Field of Search ..... 123/416, 417, 490, 643

[56] References Cited

U.S. PATENT DOCUMENTS 4,649,881 3/1987 Long ..... 123/643 X

FOREIGN PATENT DOCUMENTS 143834 12/1978 Japan ..... 123/643

28751 7/1984 Japan .

35161 2/1985 Japan ..... 123/490

*Primary Examiner*—Tony M. Argenbright

*Attorney, Agent, or Firm*—Antonelli, Terry & Wands

[57] ABSTRACT

Disclosed is an electronic ignition signal distributor for automobile engine, in which cylinders of the engine are identified using an ignition sequence counter and basing on the reference position signal and crank angle signal. The cylinder identity signal is taken AND with the distributed ignition position signal before being applied to the ignition device, thereby preventing the delivery of an active ignition signal in the event of a malfunctioning of the counter or cylinder identifying circuit, and ultimately preventing an erroneous ignition of irrelevant cylinders caused by a noise or the like.

5 Claims, 36 Drawing Figures

ELECTRONIC IGNITION SIGNAL DISTRIBUTOR FOR AUTOMOBILE ENGINE

BACKGROUND OF THE INVENTION

This invention relates to an electronic ignition signal distributor for automobile engine and, particularly, to a fail-safe electronic circuit arrangement for the ignition signal distribution system.

The conventional electronic ignition signal distributor operates to distribute the ignition signals to the ignition devices of the engine by determining the ignition sequence of the cylinders using a counter circuit in response to the detection of the timing for the reference cylinder. However, if the counter operates false due to a noise or the like, an irrelevant cylinder can be ignited erroneously, and such an event can damage the engine.

There has been proposed an ignition signal distribution system having a constitution for preventing the false operation of an electric distributor, due to double count by a counter because of a stop operation of the engine with a reversal rotation, as disclosed in Japanese Patent Publication No. 59-28751. This electronic ignition signal distributor, however, does not protect the ignition signal distribution properly in the event of a false operation, due to a noise or the like, of the counter for determining the cylinder to be ignited, resulting possibly in the ignition of an irrevelant cylinder which is in the suction stroke, for example.

SUMMARY OF THE INVENTION

An object of this invention is to provide an electronic ignition signal distributor for automobile engine capable of at least preventing the erroneous ignition of irrevelant cylinders in the event of a malfunctioning, caused by a noise or the like, of the counter which determines the ignition sequence for the cylinders.

In order to achieve the above objective, the inventive ignition signal distribution system operates to determine the igniting cylinder not only basing on the ignition sequence counter, but also using a reference position signal and crank angle signal synchronous with the engine rotation, and the ignition signal is finally delivered to each cylinder as a result of a logical-product operation between the counter output and the cylinder determination signal, thereby preventing at least the ignition of irrelevant cylinders if the counter should malfunction.

The inventive electronic ignition signal distributor characteristically includes a reference position detector coupled to the output shaft of a multicylinder engine for detecting the position of each cylinder, a crank angle detector coupled to the output shaft of the engine for detecting the rotational angle of the engine, an ignition signal producing means which receives the outputs of the two detectors and produces an ignition signal by calculating the optimal ignition timing and current conduction time length for the ignition coils, a reference cylinder signal generation means which produces, from the output signals of the reference position detector and crank angle detector, a reference cylinder signal indicative of the reference of ignition sequence, and a cylinder signal distribution means which produces, from the ignition signal, ignition position signals in accordance with the ignition sequence in response to the output signal of the reference cylinder signal generation means so that the ignition signals are supplied to the ignition coils of the cylinders after the logical-product operation between the ignition signals and the ignition position signals, wherein the reference cylinder signal generation means is provided with a means for producing a signal indicative of the cylinder to be ignited basing on the signals produced by the reference position detector and crank angle detector so that the cylinder signals form input signals of the logical-product operation.

Using a counter for determining the ignition sequence and basing on the reference position signal and crank angle signal, each cylinderis identified, and through the logical-product operation with the output signal, if the counter or a circuit for cylinder identification operates false, the ignition signal is prevented from being delivered, whereby erroneous ignition of irrevelant cylinders due to a counter malfunctioning can be prevented.

DESCRIPTION OF THE PREFERRED EMBODIMENT

Embodiments of this invention will now be described in detail.

Figure 1:
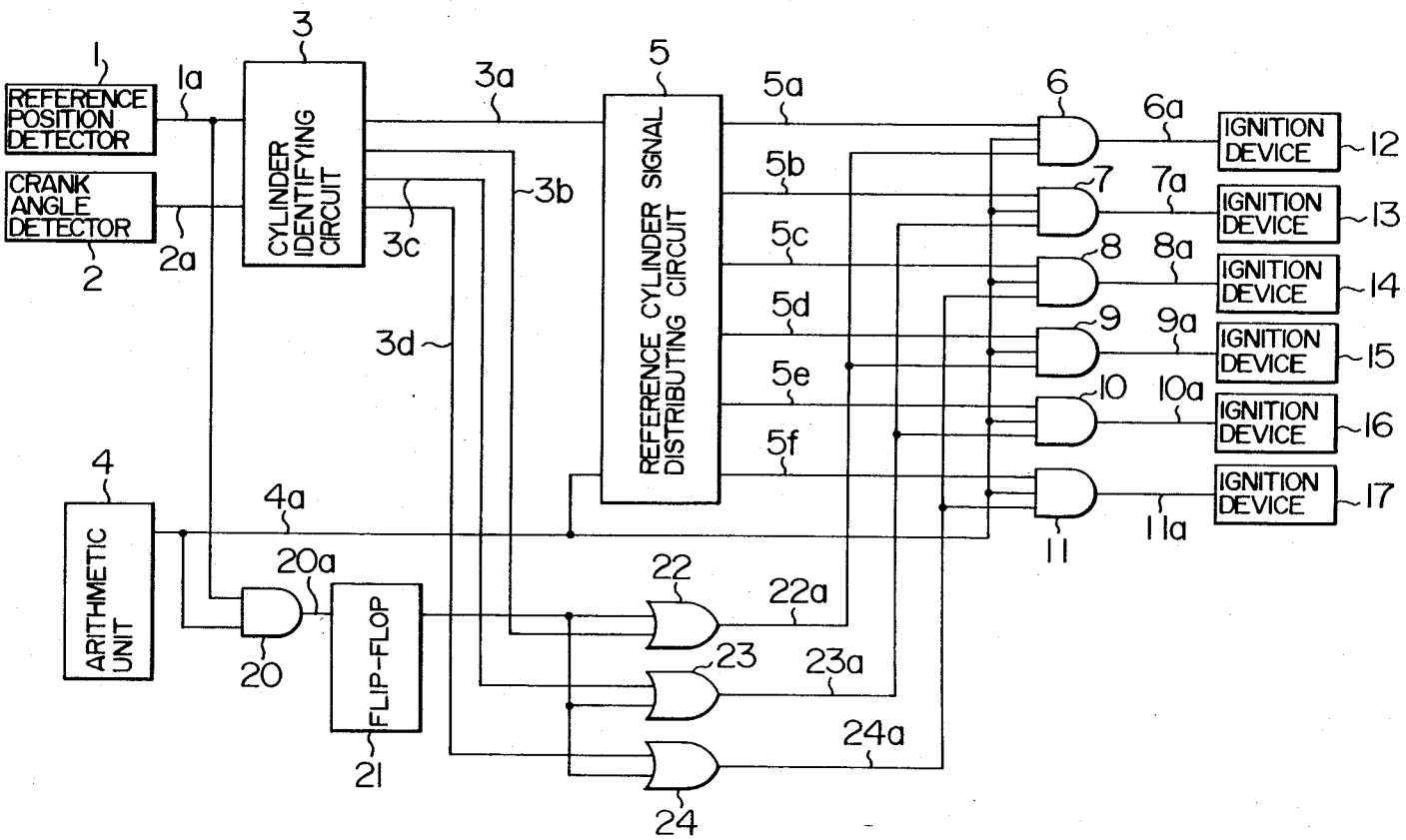
FIG. 1 is a block diagram showing the arrangement of the inventive electronic ignition signal distributor.

In FIG. 1 showing in block diagram the circuit arrangement of this invention, a reference position detector 1 and crank angle detector 2 produce a reference position signal 1*a* and crank angle signal 2*a*, respectively. A cylinder identifying circuit 3 receives these output signals to identify cylinders, and produces a reference cylinder signal 3*a*, ¼th (1st or 4th) cylinder signal 3*b*, 2/5th, (2nd or 5th) cylinder signal 3*c* and 3/6th (3rd or 6th) cylinder signal 3*d*.

Figure 2:
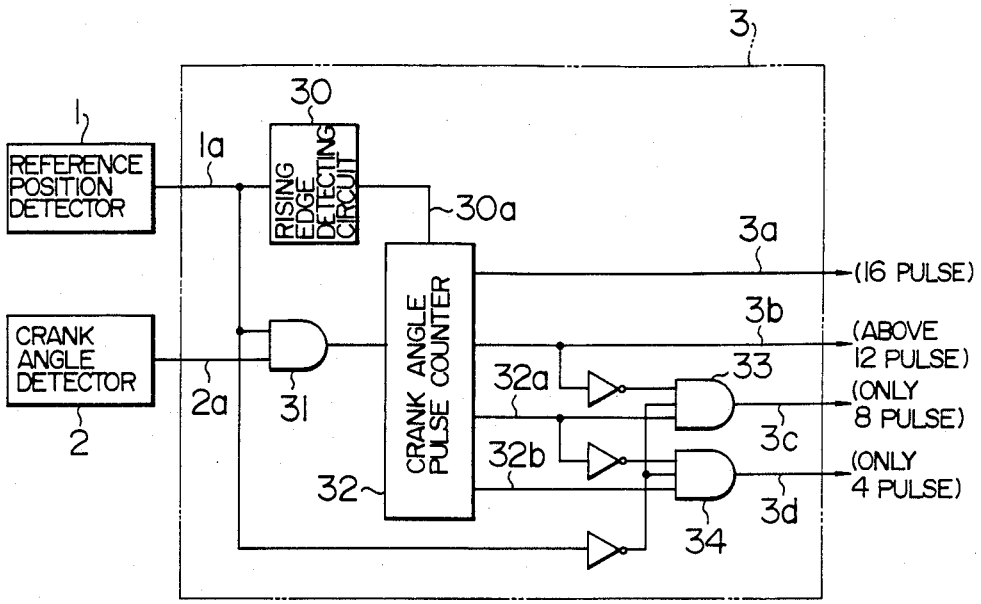
FIG. 2 is a block diagram showing in detail the cylinder identifying circuit 3 in FIG. 1.
Figure 3:
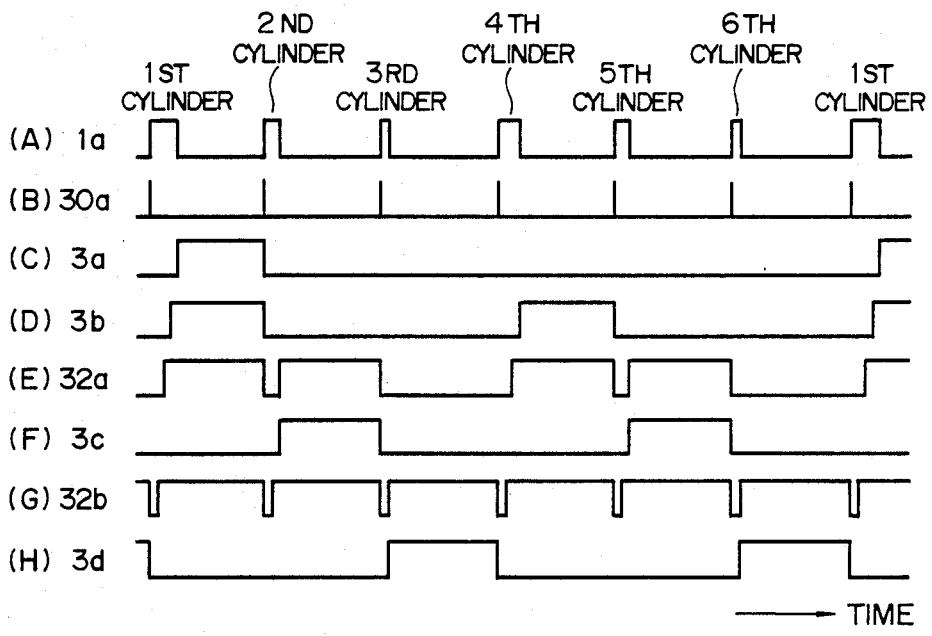
FIGS. 3(A–H) show a timing chart showing the operation of the circuit shown in FIG. 2.

The operation of the cylinder identifying circuit 3 will be explained in detail in connection with FIG. 2. The reference position signal 1*a* is a pulse signal rising at a certain angle (e.g., 110°) before the dead point of each cylinder. The crank angle signal 2*a* is a pulse train, each pulse being generated at a certain rotational angle of the engine (e.g., one pulse per 2°-rotation, or generation of 180 pulses in one engine revolution). The reference position detector 1 is designed to produce the reference position signal 1*a* which has a different pulse width for each cylinder. For example, a signal 1*a* for the first cylinder has a duration in which 16 pulses of crank angle signal 2*a* are included, a signal 1*a* for the second and fifth cylinders has a duration equivalent to 8 pulses of the signal 2*a*, a signal 1*a* for the third and sixth cylinders has a duration equivalent to 4 pulses, and a signal 1*a* for the fourth cylinder has a duration equivalent to 12 pulses. The reference position signal 1*a* is taken AND with the crank angle signal 2*a* by an AND gate 31, and its output is fed to a crank angle pulse counter 31, which counts the number of pulses of the crank angle signal 2*a* included in the pulse width of the reference position signal 1*a*. For example, the counter 32 produces a reference cylinder signal 3a for the first cylinder upon counting 16 pulses, and produces a 4th cylinder signal 3b for the fourth cylinder upon detection of 12 pulses. The counter 32 produces an 8-pulse signal 32a for the second and fifth cylinders, and produces 4-pulse signal for the third and sixth cylinders. The counter 32 is reset to the initial state in response to the generation of the next reference signal 1a, in such a manner that a pulse-rise detecting circuit 30 produces a narrow (e.g., 2 μs) clear signal 30a at the rising edge of the reference position signal 1a, as shown in FIG. 3, and this signal clears the crank angle pulse counter 32.

The above circuit arrangement is intended to identify each cylinder by counting the number of pulses of the crank angle signal 2a in the duration of the reference position signal 1a. However, as shown in the timing chart of FIG. 3, the 8-pulse signal 32a and 4-pulse signal 32b are each created in periods for multiple cylinders, and therefore signals at irrevelant cylinders must be masked off. An AND gate 33 is used to take AND for the inverted output of the 4th cylinder signal 3b, the inverted output of the reference position signal 1a and the 8-pulse signal 32a so that the 8-pulse signal is reformed to the 2/5th cylinder signal 3c. Similarly, an AND gate 34 takes AND for the 4-pulse signal 32b and the inverted outputs of the 8-pulse signal 32a and reference position signal 1a. The above circuit arrangement provides the signals for identifying cylinders.

The reference cylinder signal 3a detected as described above is fed to a reference cylinder signal distributing circuit 5 in FIG. 1, in which the signal is shifted successively by being triggered at the falling edge of an ignition signal 4a provided by an arithmetic unit 4 including a CPU, which receives the reference position signal 1a and crank angle signal 2a to calculate the ignition signal 4a. The reference cylinder signal distributing circuit 5 provides a 1st cylinder ignition position signal 5a, 2nd cylinder ignition position signal 5b, 3rd cylinder ignition position signal 5c, 4th cylinder ignition position signal 5d, fifth cylinder ignition position signal 5e, and 6th cylinder ignition position signal 5f, in accordance with the ignition sequence of each cylinder.

Figure 4:
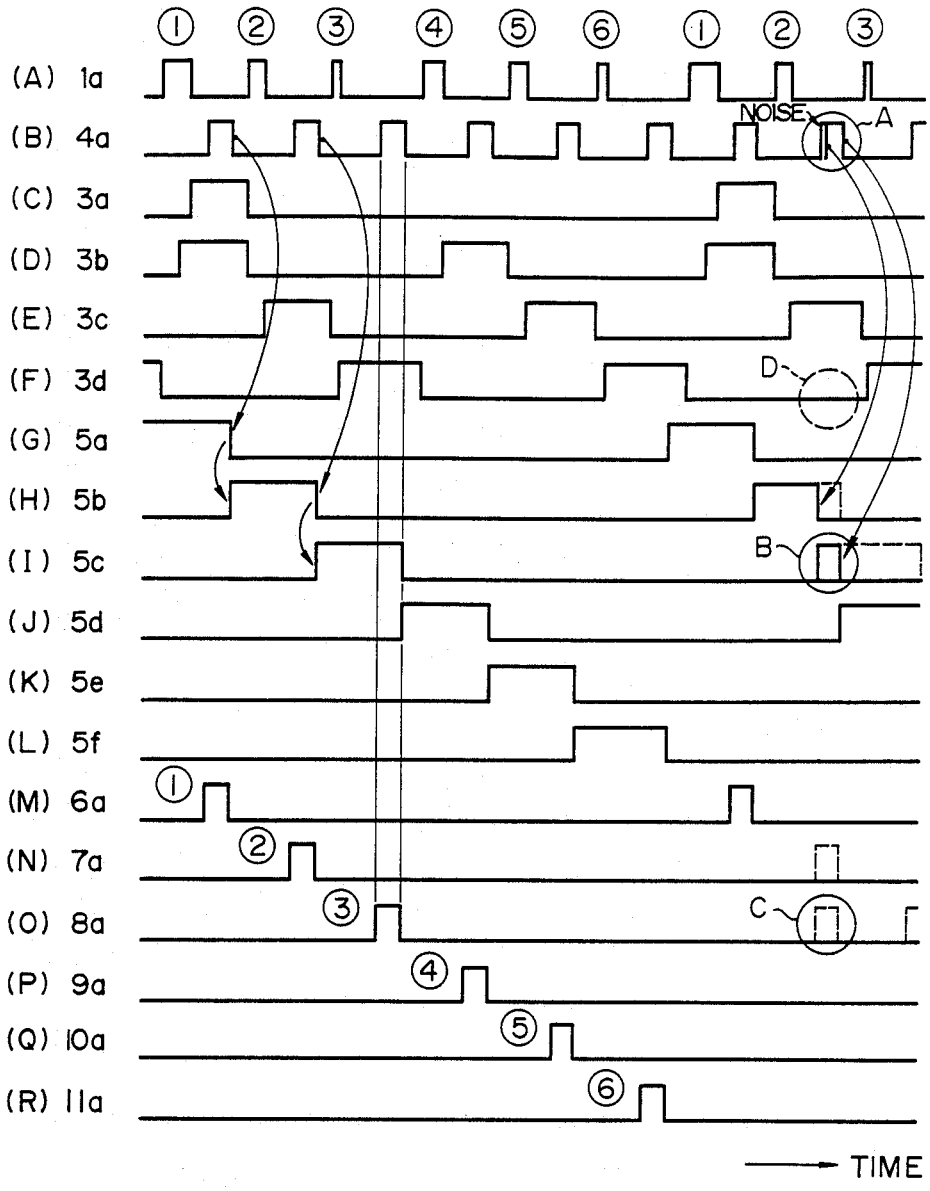
FIGS. 4(A–R) show a timing chart showing the operation of the circuit arrangement shown in FIG. 1.

In the conventional system, the ignition signal 4a is distributed to the cylinders by being simply taken AND with the cylinder ignition position signals 5a–5f. However, if the ignition signal 4a is contaminated by noises, particularly when a noise is superimposed on the ignition signal 4a at a point immediately after its rising edge as shown by A in FIG. 4, the reference cylinder signal distributing circuit 5 will erroneously respond to the noise and will be clocked to shift the reference position signal. The noise causes, at its timing, the 2nd cylinder ignition position signal 5b to go from high to low and, at the same time, the 3rd cylinder ignition position signal 5c to go high at the time point indicated by B. This results in the issuance of the 3rd cylinder ignition signal 8a at an incorrect timing indicated by C. The generation of this improper pulse is the result of logical-product between the signals 5c and 4a, and such an event occuring in the suction stroke of a cylinder can ultimately damage the engine.

According to the present invention, the logical-product operations between the ignition signal 4a and the 1st–6th cylinder ignition position signals 5a–5f further involve the cylinder signals 3b–3d by means of AND gates 6 through 11 as shown in FIG. 1, thereby immunizing the system from noises. For example, the 3rd cylinder AND gate 8 takes AND for the 3rd cylinder ignition position signal 5c, the ignition signal 4a and the 3/6th cylinder ignition signal 24a derived from the 3/6th cylinder signal 3d through an OR gate 24, resulting in a low output as shown by D in FIG. 4, and therefore even if the reference cylinder signal distributing circuit 5 should malfunction due to a noise occurring at the time point indicated by A, an active ignition pulse does not arise at the portion indicated by C. The output signals 6a–11a of the AND gates 6–11 are delivered to the respective ignition circuits 12 through 17, each of which includes an ignition coil, a primary voltage switching device connected to the coil, and an ignition plug.

The 1st cylinder AND gate 6 takes AND for the 1st cylinder ignition position signal 5a, the ¼th cylinder ignition signal 22a and the ignition signal 4a to produce the 1st cylinder ignition signal 6a. The ignition signals for the remaining cylinders are produced in the same manner.

Figure 5:
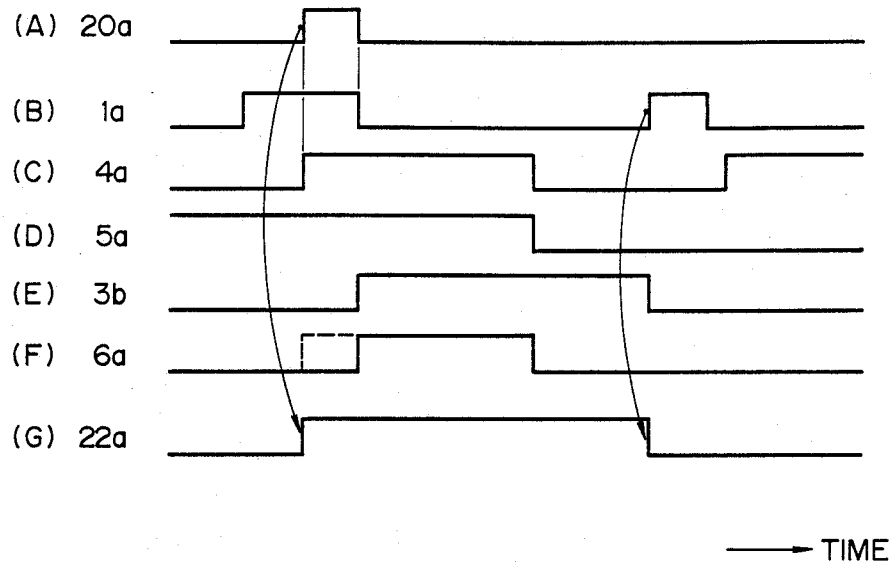
FIGS. 5(A–G) show a timing chart showing the operation when the reference position signal 1*a* and ignition signal 4*a* overlap with each other.

A flip-flop 21 is provided for the purpose of preventing the 1–6th cylinder ignition signals 6a–11a from being narrowed in their pulse width when the ignition signal 4a overlaps with the reference position signal 1a. It eventually prevents insufficient sparking caused by a decreased current supplied to the ignition coil when the ignition signal would become narrower as the engine speed increases. This is the case shown in the timing chart of FIG. 5, in which when the reference position signal 1a overlaps with the ignition signal 4a, causing the 4th cylinder signal 3b to rise at a time point near the falling edge of the reference position signal 1a, the AND operation for the 4th cylinder signal 3b and ignition signal 4a produces the 1st cylinder ignition signal 6a narrower than the ignition signal 4a, as shown by the dashed line in FIG. 5.

In order to prevent this impropriety from occuring, the signal overlap is detected to quit the AND operations between the ignition signal 4a and cylinder signals 3b–3d using the AND gate 20, flip-flop 21 and OR gates 22–24. In operation in more detail, the reference position signal 1a is taken AND with the ignition signal 4a by the AND gate 20 to detect the signal overlapping. The overlap signal 20a produced by the AND gate 20 triggers at its rising edge the flip-flop 21, which then turns the output to high. The output signal of the flip-flop 21 is taken OR with the cylinder signals 3b–3d by the OR gates 22–24 to bring the cylinder ignition signals 22a–24a to high, whereby the ignition signals 6a–11a are prevented from being narrowed. By the foregoing circuit arrangement, irrevelant cylinders are not ignited even if the reference cylinder signal distributing circuit 5 should fail due to a noise or the like.

Figure 6:
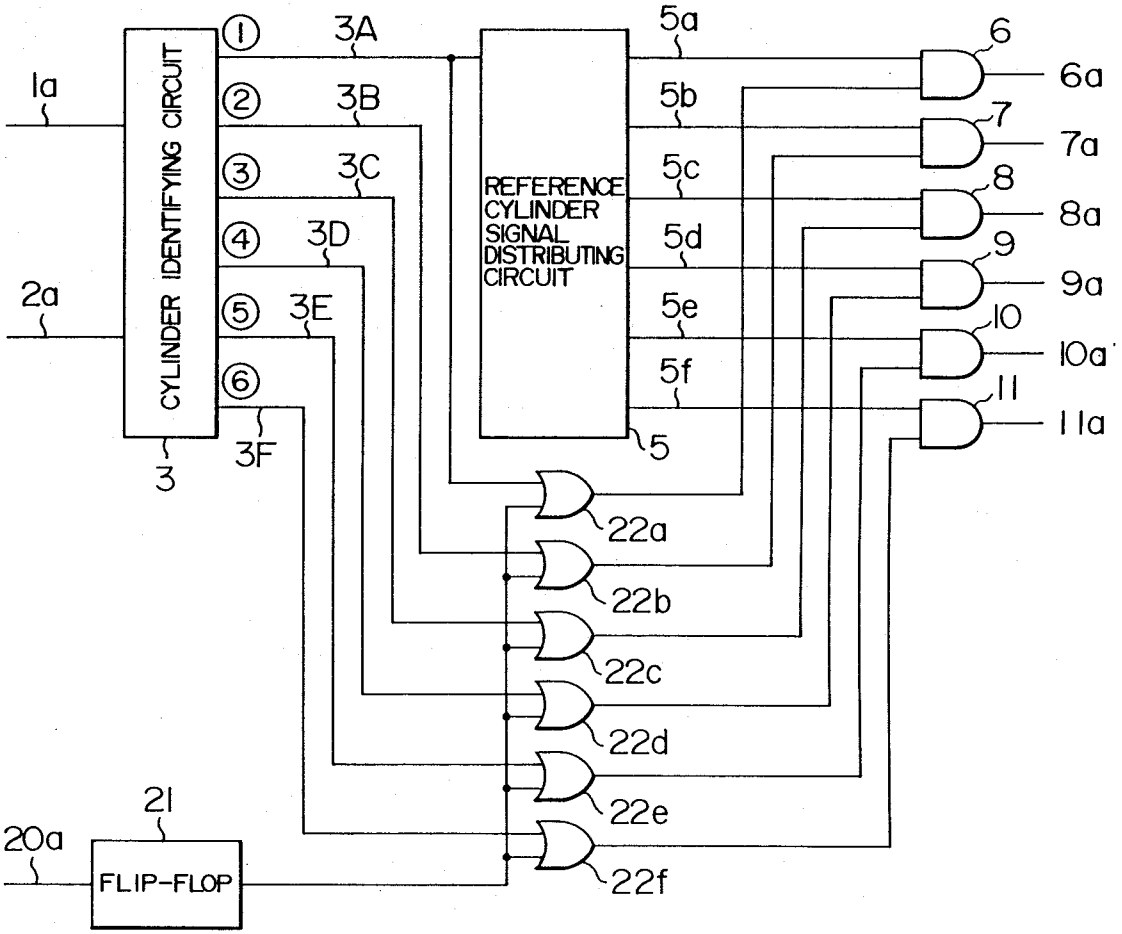
FIG. 6 is a block diagram showing the second embodiment of this invention.

FIG. 6 shows the second embodiment of this invention, in which common reference symbols are used for the components identical to those shown in FIG. 1. In the previous embodiment of FIG. 1, the second and fifth cylinders are operated by the same 8-pulse signal without the distinction between the cylinders, and this relation is also the case of the third and sixth cylinders. This is based on the reason that if one of each cylinder pair is in the suction stroke, for example, the other cylinder is naturally in the exhaust stroke, and their distinction is practically unnecessary. However, if it is intended to avoid the posibility of a backfire caused by the ignition in the exhaust stroke, it can be accomplished by providing a distinct pulse width for each of six cylinders. The circuit arrangement shown in FIG. 6 operates in principally the same manner as the operation of the foregoing embodiment, except that distinct cylinder signals 3A through 3F for identifying each cylinder are generated in this case, thereby providing the noise immunity for the ignition system.

We claim:

1. An electronic ignition signal distributor for a multi-cylinder engine comprising: a reference position detector coupled to the output shaft of said engine for detecting the position of each cylinder; a crank angle detector coupled to the ouptut shaft of said engine for detecting the rotational angle of said engine; an ignition signal producing means which receives the output signals of said two detectors and produces an ignition signal by calculating an optimal igntiion timing and current conduction time length applied to ignition coils of the cylinders; cylinder signal generating means which produces, from the output signals of said two detectors, a reference cylinder signal which provides the reference of ignition sequence and cylinder signals indicative of a cylinder to be ignited; reference cylinder signal distributing means which receives the reference cylinder signal and ignition signal and produces ignition position signals; means for producing cylinder ignition signals from the cylinder signals; logical-product means which implement logical-product operations among groups of the ignition position signals, the ignition signal and the cylinder ignition signals; and ignition circuits which receive outputs of said logical-product means.

2. An ignition signal distributor according to claim 1. wherein said reference cylinder signal generating means comprises means which receives the reference position signal and crank angle signal to define the width of the reference position signal assigned to each cylinder; detecting means which detects the rising edge of the reference position signal to produce a clear signal; and a counter which receives and counts the output of said signal-width detector in response to an output of said detecting means to produce the reference cylinder signal and cylinder signals.

3. An ignition signal distributor according to claim 1, wherein said means for producing the cylinder ignition signals comprises a logical-product means receiving the reference position signal and ignition signal; a flip-flop which receives the output signal of the logical-product means to produce a pulse signal; and logical-sum means which receive the output signal of said flip-flop and cylinder signals to produce the cylinder ignition signals.

4. An ignition signal distributor according to claim 1, wherein the number of said cylinder signals is smaller than the number of cylinders of said engine.

5. An ignition signal distributor according to claim 1, wherein the number of cylinder signals is equal to the number of cylinders of said engine.

* * * * *